US010487785B2

(12) United States Patent
Shaull

(10) Patent No.: US 10,487,785 B2
(45) Date of Patent: Nov. 26, 2019

(54) PINLESS TAPPET IN A COMMON RAIL HIGH PRESSURE FUEL PUMP

(71) Applicant: CUMMINS INC., Columbus, IN (US)

(72) Inventor: Anthony A. Shaull, Columbus, IN (US)

(73) Assignee: Cummins Inc., Columbus, IN (US)

( * ) Notice: Subject to any disclaimer, the term of this patent is extended or adjusted under 35 U.S.C. 154(b) by 127 days.

(21) Appl. No.: 15/567,656

(22) PCT Filed: Mar. 31, 2016

(86) PCT No.: PCT/US2016/025150

§ 371 (c)(1),
(2) Date: Oct. 19, 2017

(87) PCT Pub. No.: WO2016/175975

PCT Pub. Date: Nov. 3, 2016

(65) Prior Publication Data

US 2018/0135578 A1 May 17, 2018

Related U.S. Application Data

(60) Provisional application No. 62/153,694, filed on Apr. 28, 2015.

(51) Int. Cl.
*F02M 59/10* (2006.01)
*F02M 59/44* (2006.01)
(Continued)

(52) U.S. Cl.
CPC ..... *F02M 59/102* (2013.01); *F02M 59/44* (2013.01); *F01L 1/14* (2013.01);
(Continued)

(58) Field of Classification Search
CPC ..... F04B 9/042; F02M 2041/1494; F02M 59/04; F02M 59/102; F02M 59/44; F01L 2107/00
(Continued)

(56) References Cited

U.S. PATENT DOCUMENTS 2,935,878 A 5/1960 Wirsching
3,668,945 A * 6/1972 Hofmann ..... F02M 59/102 123/90.5
(Continued)

FOREIGN PATENT DOCUMENTS

JP 2001-140609 5/2001
WO 2012/079831 6/2012

OTHER PUBLICATIONS

International Search Report and Written Opinion dated Jul. 1, 2016 in PCT/US2016/025150.

*Primary Examiner* — Michael Leslie
(74) *Attorney, Agent, or Firm* — Faegre Baker Daniels LLP

(57) ABSTRACT

A system for preventing rotation of a tappet includes a tappet having an outer casing and a central axis which is configured to reciprocate linearly along the central axis. The outer casing includes a flat portion having a length along the central axis and having a width. Additionally, the system includes a lock bar fixed in position relative to the linear oscillation of the outer casing. The lock bar is positioned in proximity to the flat portion of the outer casing. Upon rotation of the outer casing about the central axis, the lock bar is configured to come into contact with the cuter casing and inhibit additional rotation of the outer casing.

24 Claims, 8 Drawing Sheets

(51) Int. Cl.

| | |
|---|---|
| *F02M 41/14* | (2006.01) |
| *F01L 1/14* | (2006.01) |
| *F02M 59/04* | (2006.01) |
| *F04B 9/04* | (2006.01) |

(52) U.S. Cl.
CPC ..... *F01L 2105/00* (2013.01); *F01L 2107/00* (2013.01); *F02M 59/04* (2013.01); *F02M 2041/1494* (2013.01); *F04B 9/042* (2013.01)

(58) Field of Classification Search
USPC ..... 92/129; 123/90.5
See application file for complete search history.

(56) References Cited

U.S. PATENT DOCUMENTS

| | | | |
|---|---|---|---|
| 4,771,741 | A | 9/1988 | Leer |
| 6,805,084 | B2 | 10/2004 | Artmann |
| 6,857,406 | B2 | 2/2005 | Matsuura et al. |
| 7,673,601 | B2 | 3/2010 | Spath |
| 8,201,532 | B2 | 6/2012 | Prokop |
| 8,235,018 | B2 | 8/2012 | Dorn et al. |
| 8,474,427 | B2 | 7/2013 | Dorn et al. |
| 2013/0186359 | A1 | 7/2013 | Aquino |
| 2013/0195692 | A1 | 8/2013 | Sakoh et al. |
| 2013/0202466 | A1 | 8/2013 | Makino |

* cited by examiner

PINLESS TAPPET IN A COMMON RAIL HIGH PRESSURE FUEL PUMP

CROSS-REFERENCE TO RELATED APPLICATIONS

The present application is a national phase filing under 35 U.S.C. § 371 of International Application No. PCT/US2016/025150, titled "PINLESS TAPPET IN A COMMON RAIL HIGH PRESSURE FUEL PUMP," filed on Mar. 31, 2016, which claims priority to U.S. Provisional Patent Application Ser. No. 62/153,694, filed on Apr. 28, 2015, and entitled "PINLESS TAPPET IN A COMMON RAIL HIGH PRESSURE FUEL PUMP," the complete disclosures of which are expressly incorporated by reference herein.

TECHNICAL FIELD OF THE DISCLOSURE

The present invention relates generally to an anti-rotation system for an oscillating cylindrical object, and more specifically to an anti-rotation device for inhibiting the rotation of oscillating tappets within a fuel pump body, cylinder block, or the like.

BACKGROUND OF THE DISCLOSURE

In one embodiment, tappets are used as a mechanism for facilitating the lifting of valves in engines and pumping fuel in fuel pumps. An example of a prior art tappet and associated components is shown in FIG. 8. Referring to FIG. 8, a tappet 808 is shown having a bottom portion and cylindrical walls extending up from the bottom portion which, together, define an outer casing 809. Additionally, tappet 808 includes a roller 806. As oriented in FIG. 8, outer casing 809 reciprocates or oscillates vertically within an inner cylindrical bore 816 of a cylinder block 814. Tappet 808 is driven in an upward direction by the rotation of a cam 802 having an irregular shape as shown, such as a lobe shape. More specifically, the rotation of cam 802 (e.g., in a counterclockwise direction) drives roller 806 (which is connected to the remainder of tappet 808 via a connection mechanism 804) in an upward direction (as oriented in FIG. 8) as an apex 818 of cam 802 approaches roller 806. Roller 806 (and thus the entire tappet 808) will be at its highest or "top" position when apex 818 is in contact with roller 806. As cam 802 continues to turn so that apex 818 is no longer in contact with roller 806, a pushrod 810 (itself and/or a spring mechanism (not shown)) pushes tappet 808 in a downward direction, causing roller 806 to remain in contact with cam 802. The top portion of tappet 808 (not shown) may be connected to a mechanism facilitating the opening and closing of valves or pumping fuel, for example.

A problem that can occur when tappet 808 operates within cylinder block 814 is that, during operation, tappet 808 can begin to rotate about its central axis L. Such rotation can damage tappet 808 and associated components because those components may collide with each other during rotation and/or affect the connection of tappet 808 to a fuel pump, cylinder block, etc. While contact between cam 802 and roller 806 during oscillation is generally sufficient to prevent tappet 808 from rotating, rotation nonetheless sometimes occurs when tappet 808 is at its top position, and occasionally when it is at its bottom position as well. To prevent such rotation, mechanisms such as a guide screw 812 have conventionally been placed through cylinder block 814 to fit within a vertical groove or elongated slot 820 cut into the outer casing of the tappet 808.

For reasons including the desirability to reduce stress on various components by reducing the moving or rotating mass of tappet 808 at high speeds, it has become desirable to make outer casing 809 of tappet 808 increasingly thin. As a result, anti-rotation mechanisms such as guide screw 812 shown in FIG. 8 can become ineffective. For example, guide screw 812 can cause tappet 808 to bend and lose its roundness if outer casing 809 of tappet 808 is thinner than that shown in FIG. 8.

SUMMARY OF THE DISCLOSURE

A system for preventing rotation of a tappet includes a tappet having an outer casing and a central axis which is configured to reciprocate linearly along the central axis. The outer casing comprises a flat portion having a length along the central axis and having a width. Additionally, the system includes a lock bar fixed in position relative to the linear oscillation of the outer casing. The lock bar is positioned in proximity to the flat portion of the outer casing. Upon rotation of the outer casing about the central axis, the lock bar is configured to come into contact with the cuter casing and inhibit additional rotation of the outer casing.

A fuel pump includes at least one cylindrical bore and a tappet positioned within the at least one cylindrical bore. The tappet has an outer casing and a central axis and is configured to reciprocate linearly along the central axis. At least a portion of the outer casing is configured to reciprocate linearly within the at least one cylindrical bore. Additionally, the fuel pump includes a rotatable cam which is in contact with the tappet to facilitate the linear oscillation of the outer casing. And, the outer casing includes a flat portion having a length along the central axis and having a width. The fuel pump also includes a lock bar fixed in position relative to the outer casing. The lock bar is positioned in proximity to the flat portion of the outer casing, and upon rotation of the outer casing about the central axis, the lock bar is configured to come into contact with the outer casing and inhibit additional rotation of the outer casing.

BRIEF DESCRIPTION OF THE DRAWINGS

The features of this disclosure and the manner of obtaining them will become more apparent and the disclosure itself will be better understood by reference to the following description of embodiments of the present disclosure taken in conjunction with the accompanying drawings, wherein.

Figure 1:
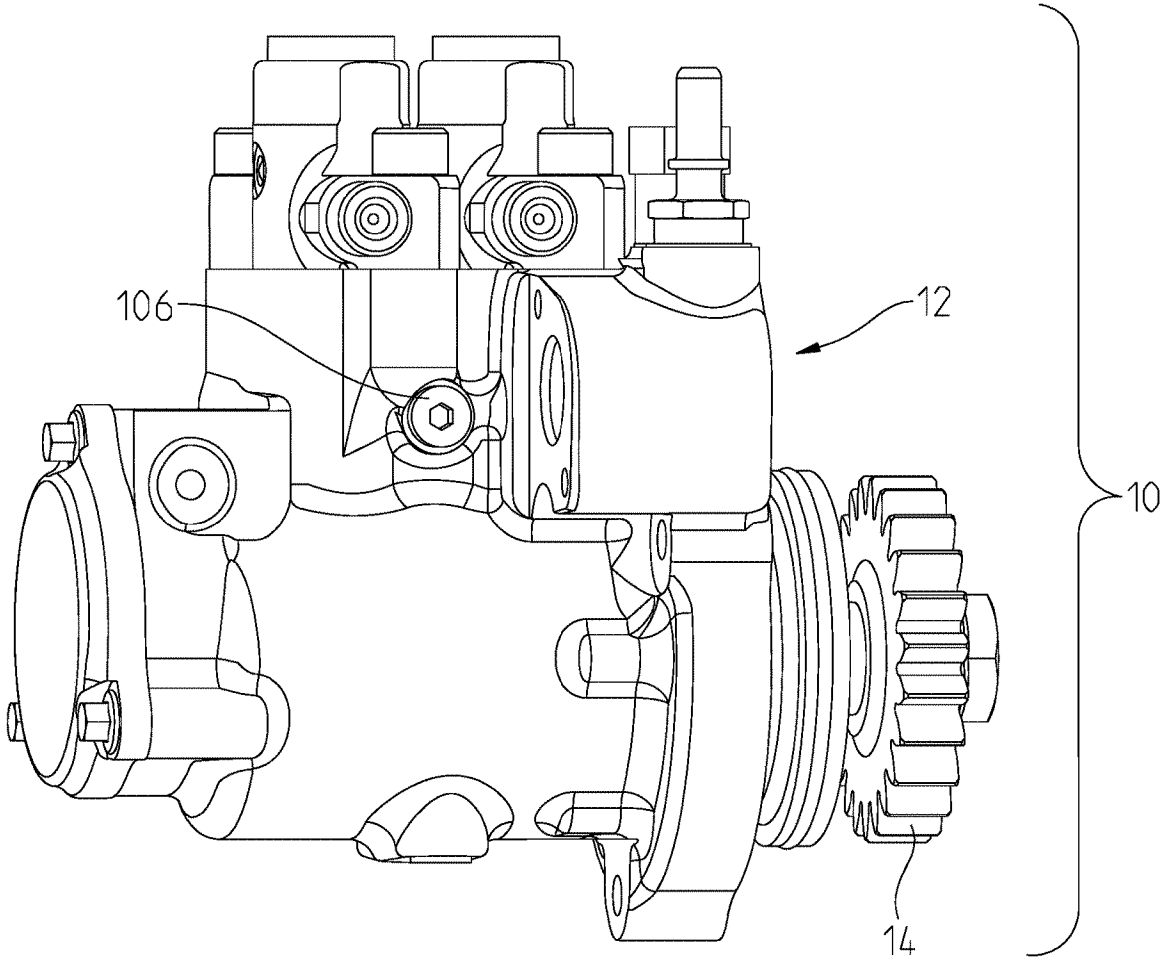
FIG. 1 is a perspective view of a fuel pump for use with an anti-rotation system for a tappet of the present disclosure.

While embodiments of the present invention are amenable to various modifications and alternative forms, specific embodiments have been shown by way of example in the drawings and are described in detail below. The intention, however, is not to limit the particular embodiments described herein. On the contrary, the invention is intended to cover all modifications, equivalents, and alternatives falling within the scope of the invention as defined by the appended claims.

DETAILED DESCRIPTION OF THE DRAWINGS

A tappet may be a device which imparts linear motion to various components. For example, tappets may be used on engines for imparting linear motion to a pushrod based on rotational motion from a cam shaft. Tappets also may be used with a fuel pump for an engine, as disclosed herein.

A fuel pump 10 configured for use with an engine (not shown) is disclosed herein in FIGS. 1-7. In particularly, fuel pump 10 may include an outer housing 12 and at least one engagement member 14, illustratively a gear, configured to engage with a portion of the engine. For example, engagement member 14 may be configured to engage or mesh with a gear driven by the crankshaft (not shown) of the engine for providing rotational or other movement to fuel pump 10 to pump fuel therein to the engine.

Figure 2:
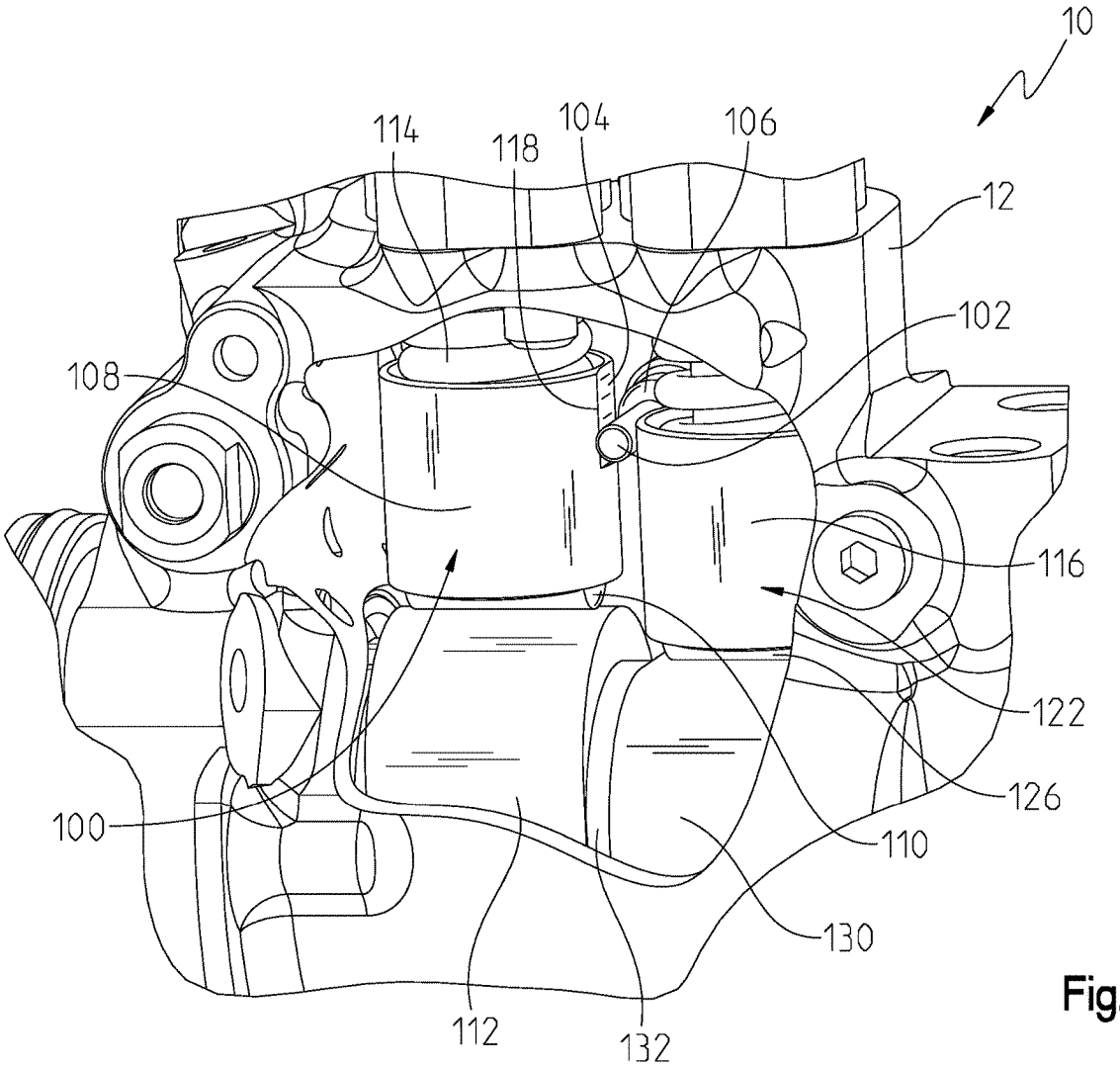
FIG. 2 is a front perspective view of the fuel pump of FIG. 1 with a cut-away portion illustrating a portion of the anti-rotation system for the tappet of FIG. 1.
Figure 3:
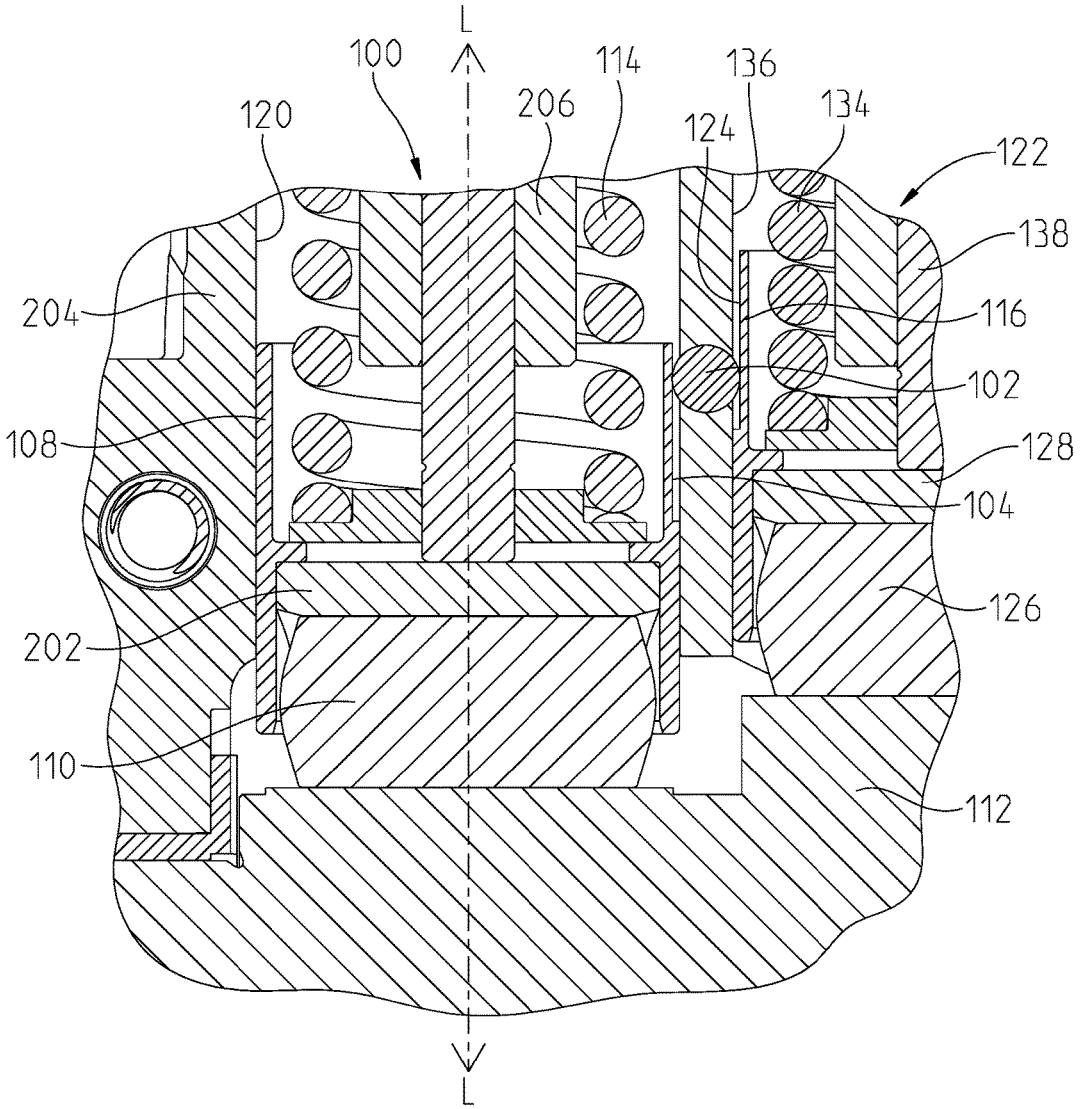
FIG. 3 is a cross-sectional view of the anti-rotation system of FIG. 2.

Referring to FIGS. 2 and 3, fuel pump 10 includes an anti-rotation system for a tappet 100 (FIG. 3) which is positioned within a portion of outer housing 12 of fuel pump 10. According to one embodiment, tappet 100 of fuel pump 10 includes a cylindrical outer casing 108 having a flat portion 104, a roller 110, and a bottom portion 202 (FIG. 3). Illustratively, fuel pump 10 also may include a second tappet 122 which includes a second outer casing 116 having a second flat portion 124, a second roller 126, and a second bottom portion 128. A lock bar or protrusion 102, affixed to a mount 106 which is coupled to a portion of the engine or fuel pump 10, is positioned in close proximity to flat portion 104 of first tappet 100 and flat portion 124 of second tappet.

Referring to FIGS. 2 and 3, lock bar 102 is provided to prevent, inhibit, deter, or minimize rotation of each of outer casings 108, 116 of tappets 100, 122 about its central axis L. More particularly, if, during operation of fuel pump 10, any of outer casings 108, 116 begin to rotate about its central axis L (FIG. 3) due to vibrations transmitted to fuel pump 10 from the engine for example, lock bar 102 comes into contact with a side boundary 118 of flat portions 104, 124 of respective tappets 100, 122 to prevent outer casings 108, 124 (and other portions of tappets 100, 122) from rotating further. Though not shown in FIG. 2, in other embodiments, flat portions 104, 124 each may have another side boundary on the opposite side of respective outer casings 108, 116 from where side boundary 118 is shown in FIG. 2.

Referring still to FIG. 2, roller 110 of tappet 100 is configured to be positioned or sit atop a cam 112. Additionally, roller 126 of tappet 122 is configured to be positioned or sit atop a cam 130. Cams 112, 130 may be operably coupled together by a cam shaft 132. Cams 112, 130 may be positioned within fuel pump 10 and/or may be operably coupled to a portion of fuel pump 10. In one embodiment, cams 112, 130 each have an irregular shape, such as a lobe or oblong oval. As cams 112, 130 rotate, rollers 110, 126 and outer casings 108, 116 of respective tappets 100, 122 reciprocate or oscillate vertically (as oriented in FIG. 2). For example, as cam 112 rotates away from its top position (i.e., where an apex (not shown) of cam 112 rotates away from roller 110), a spring 114 of tappet 100 biases tappet 100 downward, keeping roller 110 in contact with cam 112. Similarly, as cam 130 rotates away from its top position, a spring 134 of tappet 122 biases tappet 122 downward, keeping roller 126 in contact with cam 130.

Figure 4:
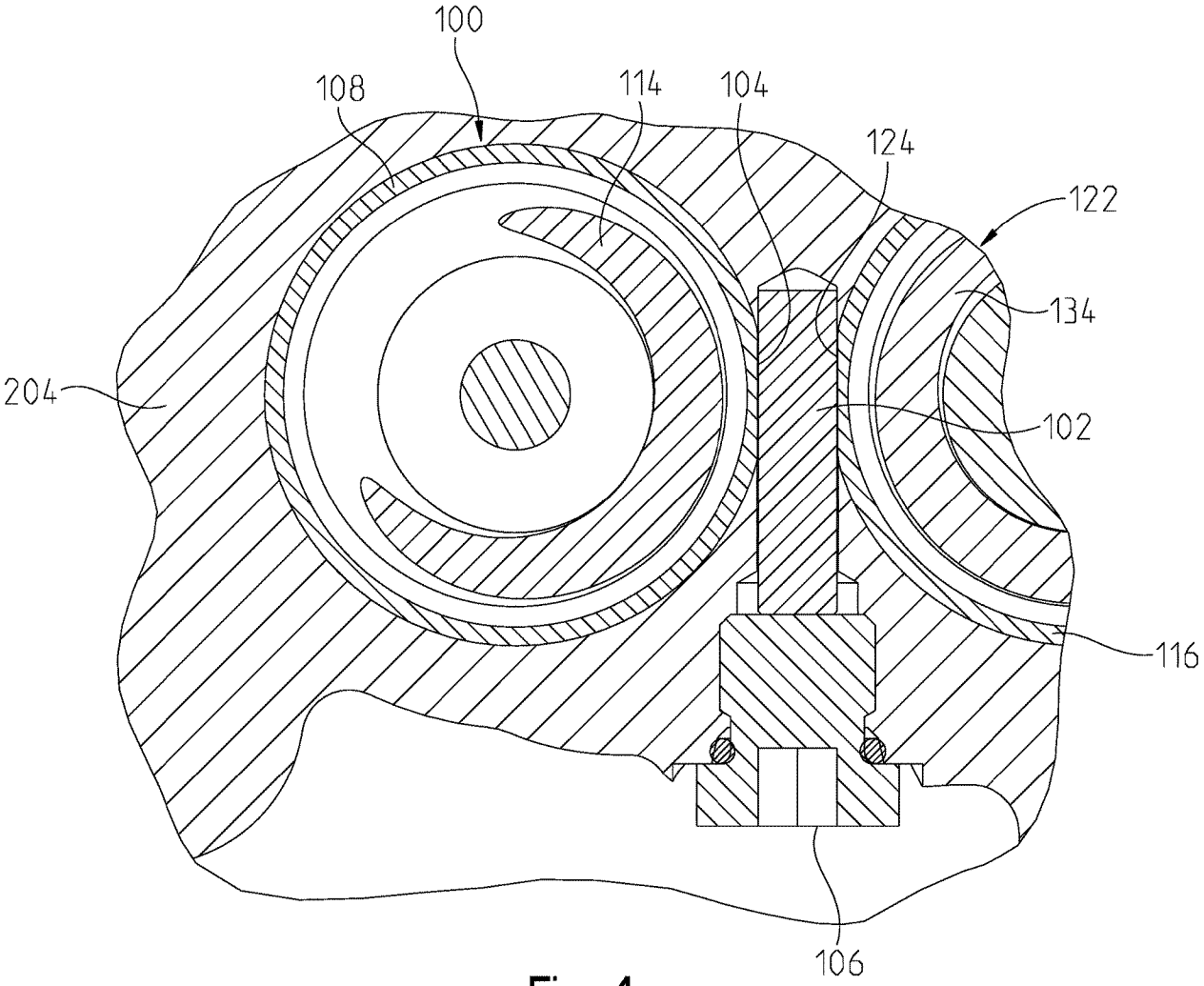
FIG. 4 is a further cross-sectional view of a top portion of the anti-rotation system of FIG. 2.

Illustratively, and as shown in FIGS. 2-4, lock bar 102 is cylindrical (dowel-shaped), though other embodiments may have any other shapes (e.g., may define a rectangle, truncated circle, oval, or any other shape in cross-section). In one embodiment, the diameter of lock bar 102 is 2-10 mm, and more particularly 5 mm. Additionally, lock bar 102 may be comprised of a metallic material. For example, in one embodiment, lock bar 102 is comprised of an alloy steel having a minimum hardness of 52 HRc that meets DIN 7 m6 specifications. However, it should be understood that the specific dimensions and other parameters mentioned above are by way of example, and that embodiments of the present invention contemplate the usage of outer casings and lock bars having/using a variety of dimensions, shapes, materials, and other characteristics.

During operation of fuel pump 10, and referring to FIGS. 2-4, outer casing 108 reciprocates vertically within a cylindrical bore 120 of fuel pump 10 and/or of a cylinder block 204 of the engine and may be moved in an upward direction (as oriented in FIG. 3) by the rotation of cam 112 pushing up on roller 110 (which pushes up on bottom portion 202 of tappet 100) as cam 112 approaches its top position (i.e., as the apex of cam 112 approaches roller 110). As cam 112 rotates past its top position, spring 114 biases or pushes tappet 100 in a downward direction to maintain contact between roller 110 and cam 112. In one embodiment, a plunger 206 of first tappet 100 is in communication with bottom portion 202 to facilitate the pumping of fuel into the engine.

Additionally, during this oscillating movement of first tappet 100, outer casing 116 of second tappet 122 reciprocates vertically within a cylindrical bore 136 of fuel pump 10 and/or of cylinder block 204 of the engine and may be moved in an upward direction (as oriented in FIG. 3) by the rotation of cam 130 pushing up on roller 126 (which pushes up on bottom portion 128 of tappet 122) as cam 130 approaches its top position (i.e., as the apex of cam 130 approaches roller 126). As cam 130 rotates past its top position, spring 134 of second tappet 122 biases or pushes tappet 122 in a downward direction to maintain contact between roller 126 and cam 130. In one embodiment, a plunger 138 is in communication with bottom portion 128 of tappet 122 to facilitate the pumping of fuel into the engine.

Referring to FIG. 4, mount 106 holds lock bar 102 in place on the engine and/or on outer housing 12 of fuel pump 10. In some embodiments, a portion of mount 106 is accessible from an outer portion of cylinder block 204 and outer housing 12 of fuel pump 10, thereby allowing the removal of mount 106 and lock bar 102 from the outer portion of the cylinder block 204 and/or outer housing 12 of fuel pump 10. Additionally, in one embodiment, lock bar 102 can be positioned at various angles relative to outer casings 108, 116, and can be held in place using various types of techniques and designs. Lock bar 102 can also be of various shapes and configurations as discussed below.

Figure 5:
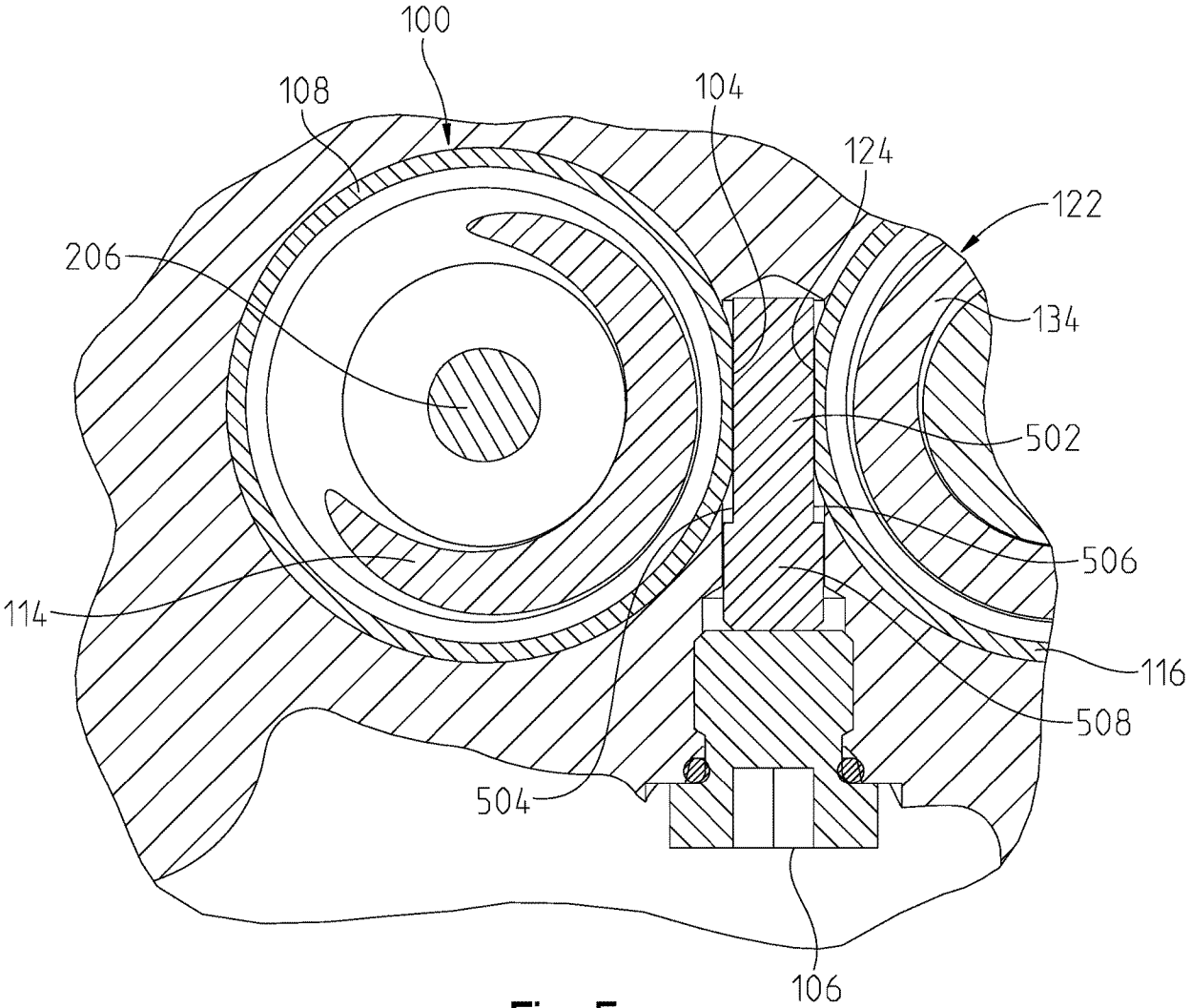
FIG. 5 is a perspective view of an outer casing of the tappet of the anti-rotation system of FIG. 2.

Referring to FIG. 5, an alternative embodiment lock bar 502 of the anti-rotation system for tappets 100, 122 is shown. Lock bar 502 is positioned intermediate outer casings 108, 116 of first and second tappets 100, 122, respectively, and includes opposing flat surfaces 504, 506 which are proximate to flat portions 104, 124 of respective outer casings 108, 116 to complementarily abut flat portions 104, 124. Conversely, lock bar 502 shown in FIG. 5 may have a rounded outer surface. Additionally, lock bar 502 may extend from a base portion 508 which is coupled to mount 106. Base portion 508 may have a different cross-sectional configuration than lock bar 502. For example, base portion 508 may define a circle in cross-section whereas lock bar 502 may define a rectangle in cross-section. In one embodiment, base portion 508 is integral with lock bar 502.

Figure 6:
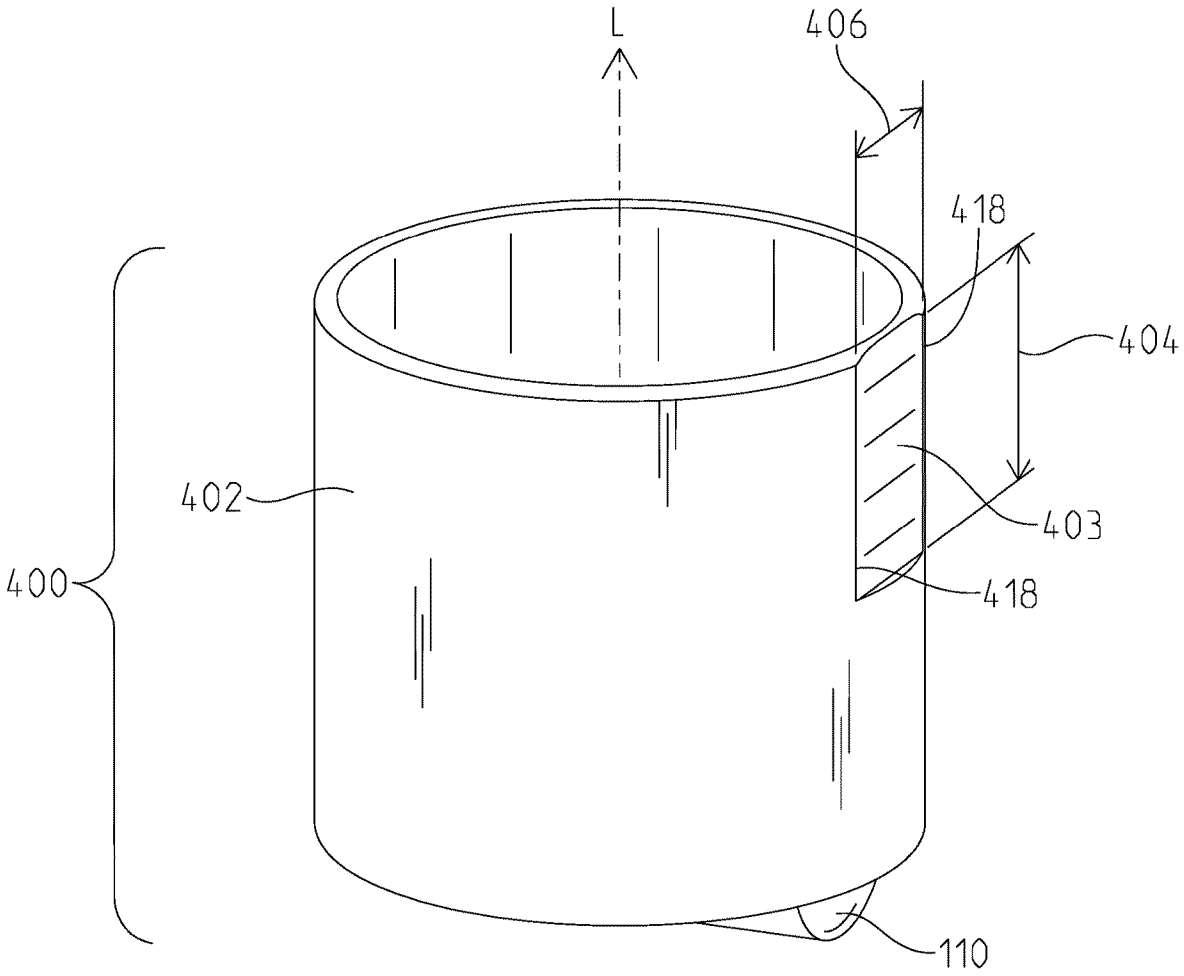
FIG. 6 is a cross-sectional view of a top portion of an alternative embodiment lock bar of the anti-rotation system of FIG. 2.

FIG. 6 is a perspective view of an alternative embodiment tappet 400 with an outer casing 402 which has a flat portion 403. Flat portion 403 of tappet 400 includes side boundaries 418 which are rounded, instead of having sharp corners, at the interface between flat portion 403 and the remainder of outer casing 402. It is contemplated that the length 404 of flat portion 403 parallel to the central axis L of tappet 400 is at least equal to of the range of motion that tappet 400 is caused to reciprocate by cam 112 (FIG. 2). Thus, for example, if the distance that tappet 400 moves from its lowest point to its highest (top) point is 12 mm, then length 404 of flat portion 403 is contemplated to be at least 12 mm. Also, it should be appreciated that flat portion 403 can be placed on any portion of outer casing 402, and need not reach to the top end of outer casing 402, as shown in the example of FIG. 5.

Referring still to FIG. 6, a width 406 of flat portion 403 is orthogonal to central axis L and is sized to inhibit the rotation of outer casing 402 (and thus tappet 402) about its central axis L during operation of fuel pump 10. As will be appreciated by those skilled in the art, factors contributing to fashioning an appropriate width 406 and length 404 include anticipated torque associated with possible rotation of tappet 400, the diameter and thickness of outer casing 402, and the materials used to make outer casing 402 and lock bar 102.

In one embodiment, the length 404 of flat portion 403 parallel to central axis L is 8-20 mm, and more particularly 12 mm, while the width 406 (orthogonal to central axis L) is 5-12 mm, and more particularly 8.32 mm. In general, the width 406 is maximized for a given outer diameter of the tappet 400 and thickness of the wall of tappet 400. The inner radius of the outer casing 402 is 10-20 mm, and more particularly 14.6 mm, and the thickness of the top part of outer casing 402 at any point other than the flat portion 403 is 0.5-5 mm, and more particularly 2.4 mm. The thickness of outer casing 402 at flat portion 403 may have the lowest thickness value and is defined as the thinnest point of outer casing 402. For example, the thickness of flat portion 403 may be 0.65 mm. The material used for outer casing 403 may be a metallic material, such as steel. For example, ASTM A29 4140 Alloy Steel (UNS G41400), generally having a hardness of 40-45 HRc, may comprise outer casing 403.

Additionally, FIG. 7 shows other alternative embodiment lock bars 602*a-f* positioned adjacent outer casing 108 of tappet 100 (FIG. 2). Lock bar 602*a* of FIG. 7A depicts a cylindrical (dowel) lock bar configured to abut or otherwise engage flat portion 104 of outer casing 108. In one embodiment, lock bar 602*a* may have a continuous diameter along its entire length.

Figure 7A:
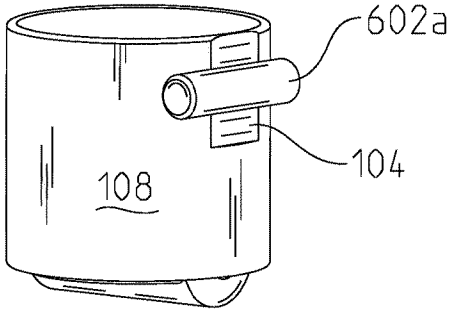
FIG. 7A is a perspective view of an alternative embodiment lock bar positioned adjacent the outer casing.
Figure 7B:
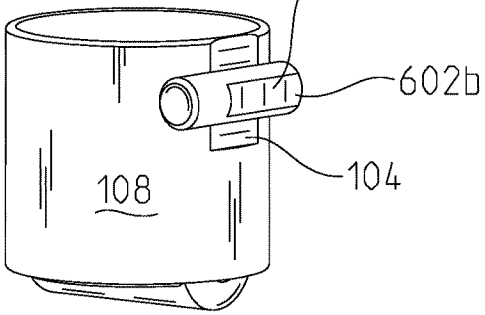
FIG. 7B is a perspective view of another alternative embodiment lock bar positioned adjacent the outer casing.
Figure 7C:
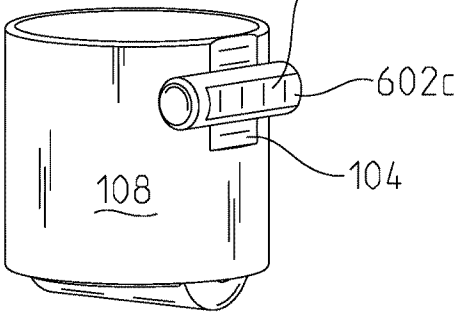
FIG. 7C is a perspective view of a further alternative embodiment lock bar positioned adjacent the outer casing.

Alternatively, lock bars 602*b* and 602*c* of FIGS. 7B and 7C depict two different embodiments of flat cut lock bars, each having a respective tapered or flat portion 610, 612 configured to engage flat portion 104 of outer casing 108. In one embodiment, flat portion 610, 612 may have different lengths. For example, the length of flat portion 612 of lock bar 602*c* may be greater than the length of flat portion 610 of lock bar 602*b*. With the lock bars 602*b*, 602*c*, more surface area of locks bars 602*b*, 602*c* is configured to contact or abut flat portions 104 of outer casing 108 when the tappet 100 rotates than with comparably-sized dowel-shaped lock bar, such as lock bar 602*a*.

Figure 7D:
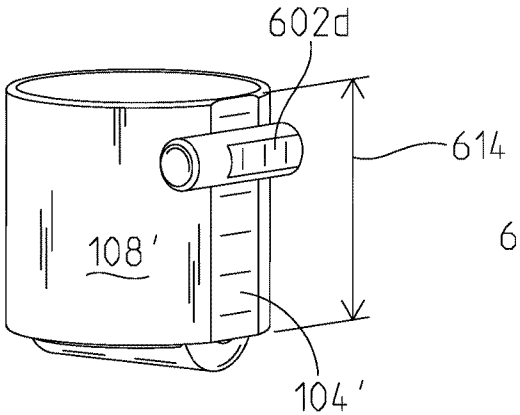
FIG. 7D is a perspective view of another alternative embodiment lock bar positioned adjacent the outer casing.

In a further embodiment, and as shown in FIG. 7D, lock bar 602*d* may define a continuous cylindrical shape similar to lock bar 602*a* of FIG. 7A. However, as shown in FIG. 7D, an alternative embodiment outer casing 108' includes an elongated flat portion 104' which extends from the top edge to the bottom edge of outer casing 108'. As such, the length 614 of flat portion 104' which extends parallel to central axis L (FIG. 3) of outer casing 108' extends the entire length of outer casing 108'. Lock bar 602*d* is configured to abut any portion of flat portion 104' of outer casing 108'.

Figure 7E:
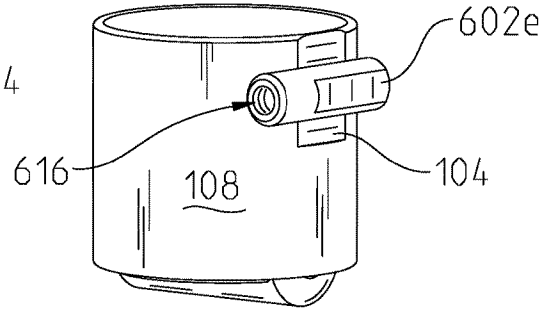
FIG. 7E is a perspective view of a further alternative embodiment lock bar positioned adjacent the outer casing.

Referring now to FIG. 7E, lock bar 602*e* has a continuous hollow cylindrical configuration. The hollow configuration of lock bar 602*e* defines a central opening 616 extending the entire length of lock bar 602*e*. In one embodiment, central opening 616 may be configured to receive a tool or other device which correctly positions lock bar 602*e* adjacent tappet 100, 122. For example, central opening 616 may include a plurality of threads configured to receive a threaded maintenance tool which manipulates the position of lock bar 602*e*. Additionally, the tool may be used to remove and/or insert lock bar 602*e* between tappets 100, 122.

Figure 7F:
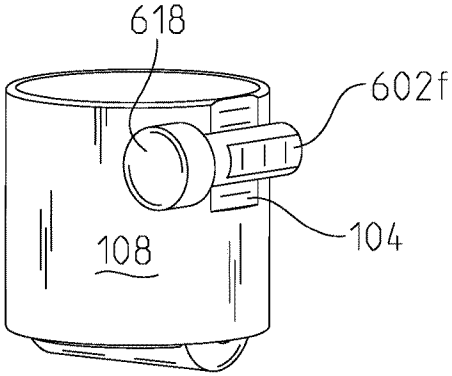
FIG. 7F is a perspective view of another alternative embodiment lock bar positioned adjacent the outer casing.
Figure 8:
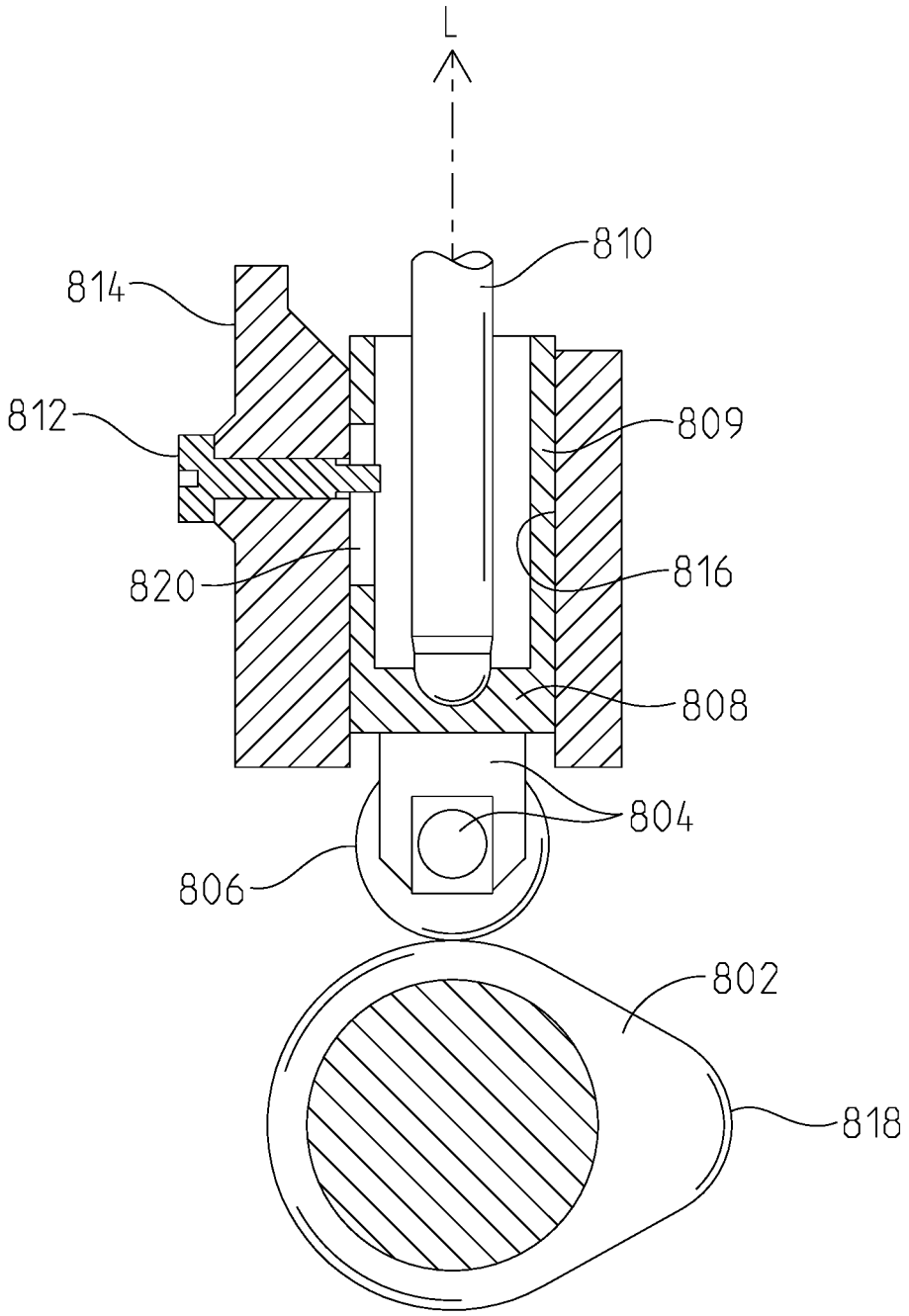
Fig. 8 (Prior Art)
FIG. 8 is a side view of a prior art tappet and associated components.

Referring now to FIG. 7F, lock bar 602*f* includes a base portion 618 similar to base portion 508 (FIG. 5) extending from lock bar 602*f*. In one embodiment, both lock bar 602*f* and base portion 618 have a cylindrical configuration, however, the diameter of base portion 618 is greater than the diameter of lock bar 602*f*. Base portion 618 may provide an improved surface for coupling lock bar 602*f* to mount 106 (FIG. 3) and/or may be used to adjust the position of lock bar 602*f* relative to tappets 100, 122.

It should be understood that the present disclosure contemplates any number of other configurations of flat areas and types of lock bars. This includes embodiments where the lock bar, upon rotation about its central axis L, would come into contact with a portion of the outer casing 108 other than one of the side boundaries 118, e.g., in view of the size and/or position of the lock bar.

As mentioned above, it is envisioned that one or more tappets 100, 122 as well as components of the anti-rotation system are configured for use with fuel pump 10. In embodiments of the present disclosure, a portion of mount 106 extends to an outer portion of fuel pump 10, and is designed to be inserted and removed from the fuel pump 10. In this way, lock bar 102, 502, 602*a-f* (which is affixed to the mount 106) can readily be removed and replaced as desired. It should be understood that the concept of the removability of mount 106 and affixed lock bar 102, 502, 602*a-f* can be applied to other devices using tappets 100, 122 and other oscillating cylindrical objects. It should also be understood that lock bar 102, 502, 602*a-f* may be made to be readily removable from mount 106 and replaceable.

It should be understood that, depending on the length of lock bar 102, 502, 602*a-f* (or any lock bar envisioned by the present disclosure), lock bar 102, 502, 602*a-f* can be used to inhibit the rotation about central axis L of any number of tappets 100, 122.

It also should be understood that usage herein of orientation-related terms such as "top," "upward" and "vertical" are used to assist in the explanation of the various embodiments of the present invention, and that it is envisioned that the embodiments described herein can be positioned and oriented in any number of ways. Similarly, terms such as "length" and "width" are also used for explanation purposes and their general usage does not, itself, imply that a length is necessarily larger than a width.

Additionally, it should be understood that the various embodiments contemplated herein can be used as in conjunction with (and can themselves be) engines and fuel pumps, although the embodiments of the present invention are not limited thereto.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. A system for preventing rotation of a tappet, comprising:

a first tappet, having a first outer casing and a central axis, being configured to reciprocate linearly along the central axis, the first outer casing comprising a bottom portion and a first flat portion, the first flat portion having a length parallel to the central axis and having a width, wherein the first tappet is coupled to a roller by having the bottom portion of the first outer casing abut the roller; and a lock bar fixed in position relative to the linear reciprocation of the first outer casing, the lock bar positioned in proximity to the first flat portion of the first outer casing, and upon rotation of the first outer casing about the central axis, the lock bar being configured to come into contact with the first outer casing and inhibit additional rotation of the first outer casing.

2. The system of claim 1, wherein the lock bar is cylindrical.

3. The system of claim 1, wherein the lock bar includes a flat surface.

4. The system of claim 3, further comprising a second tappet having a second outer casing and the second outer casing having a second flat portion, wherein the lock bar is configured to inhibit rotation of the second outer casing.

5. The system of claim 1, wherein the first tappet is configured to reciprocate linearly along the central axis within a predetermined range of motion and the length of the first flat portion is at least equal to the predetermined range of motion.

6. The system of claim 1, wherein the lock bar is positioned orthogonally to the central axis.

7. The system of claim 1, wherein the lock bar comprises a base portion coupled to a mount.

8. The system of claim 1, wherein the lock bar defines a hollow cylinder having an open central conduit.

9. The system of claim 8, wherein the open central conduit is configured to engage with a threaded positioning tool.

10. A fuel pump, comprising:

a first tappet positioned within at least one cylindrical bore and having a first outer casing and a central axis, the first tappet configured to reciprocate linearly along the central axis, the first outer casing including a bottom portion and a first flat portion, the first flat portion having a length along the central axis and having a width, wherein the first tappet is coupled to a roller by having the bottom portion of the first outer casing abut the roller;

a rotatable cam, the rotatable cam being in contact with the roller to facilitate the linear reciprocation of the first tappet; and a lock bar fixed in position relative to the first outer casing, the lock bar being positioned in proximity to the first flat portion of the first outer casing, and upon rotation of the first outer casing about the central axis, the lock bar being configured to come into contact with the first outer casing and inhibit additional rotation of the first outer casing.

11. The fuel pump of claim 10, wherein the first flat portion of the first outer casing has side boundaries, and upon rotation of the first outer casing about the central axis, the lock bar is configured to come into contact with one of the side boundaries.

12. The fuel pump of claim 11, wherein the side boundaries are rounded.

13. The fuel pump of claim 10, comprising a second tappet having a second outer casing and the second outer casing having a second flat portion, wherein the lock bar is configured to inhibit rotation of the second outer casing.

14. The fuel pump of claim 10, wherein the lock bar is cylindrical.

15. The fuel pump of claim 10, wherein the first tappet is configured to reciprocate linearly along the central axis within a predetermined range of motion and the length of the first flat portion is at least equal to the predetermined range of motion.

16. The fuel pump of claim 10, wherein the lock bar comprises a base portion coupled to a mount.

17. The fuel pump of claim 16, wherein the mount is coupled to an outer surface of the fuel pump.

18. The fuel pump of claim 10, wherein the lock bar defines a hollow cylinder having an open central conduit.

19. The fuel pump of claim 18, wherein the open central conduit is configured to engage with a threaded positioning tool.

20. The fuel pump of claim 10, wherein the lock bar comprises a flat surface.

21. The system of claim 1, wherein the first flat portion of the first outer casing extends from a first edge of the first outer casing to a second edge of the first outer casing, the second edge being adjacent to the roller and opposite the first edge.

22. The fuel pump of claim 10, wherein the first flat portion of the first outer casing extends from a first edge of the first outer casing to a second edge of the first outer casing, the second edge being adjacent to the roller and opposite the first edge.

23. A system for preventing rotation of a tappet, comprising:

a tappet, having an outer casing and a central axis, being configured to reciprocate linearly along the central axis, the outer casing comprising a flat portion having a length parallel to the central axis and having a width; and a lock bar fixed in position relative to the linear reciprocation of the outer casing, the lock bar positioned in proximity to the flat portion of the outer casing, and upon rotation of the outer casing about the central axis, the lock bar being configured to come into contact with the outer casing and inhibit additional rotation of the outer casing, wherein the lock bar defines a hollow cylinder having an open central conduit.

24. A system for preventing rotation of a tappet, comprising:

a tappet, having an outer casing and a central axis, being configured to reciprocate linearly along the central axis, the outer casing comprising a first edge, a second edge, and a flat portion, the second edge being adjacent to a roller and opposite the first edge, the flat portion having a length parallel to the central axis and having a width, wherein the flat portion extends from the first edge of the outer casing; and a lock bar fixed in position relative to the linear reciprocation of the outer casing, the lock bar positioned in proximity to the flat portion of the outer casing, and upon rotation of the outer casing about the central axis, the lock bar being configured to come into contact with the outer casing and inhibit additional rotation of the outer casing.

* * * * *